US005942849A

United States Patent [19]

Cade

[11] Patent Number: 5,942,849

[45] **Date of Patent: *Aug. 24, 1999**

[54] ELECTRON FIELD EMISSION DEVICES

[75] Inventor: Neil Alexander Cade, Herts, United Kingdom

[73] Assignee: GEC-Marconi Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/861,186

[22] Filed: May 21, 1997

Related U.S. Application Data

[63] Continuation of application No. 08/359,412, Dec. 20, 1994, abandoned.

[30] Foreign Application Priority Data

Dec. 22, 1993 [GB] United Kingdom ..... 9326151

[51] Int. Cl.[6] ..... H01J 31/12; H01J 3/02

[52] U.S. Cl. ..... 313/495; 313/496; 313/497; 313/309; 313/336

[58] Field of Search ..... 313/495, 496, 313/497, 422, 309, 336, 351, 386

[56] References Cited

U.S. PATENT DOCUMENTS

| | | | |
|---|---|---|---|
| 3,935,500 | 1/1976 | Oess et al. | 313/495 |
| 4,540,983 | 9/1985 | Morimoto . | |
| 4,908,539 | 3/1990 | Meyer . | |
| 4,955,681 | 9/1990 | Sebihara et al. | 313/495 |
| 5,235,244 | 8/1993 | Spindt | 313/495 |
| 5,336,888 | 8/1994 | Odom | 313/386 |
| 5,424,605 | 6/1995 | Lovoi | 313/495 |

FOREIGN PATENT DOCUMENTS

| | | |
|---|---|---|
| 0 349 425 | 1/1990 | European Pat. Off. . |
| 0 391 139 | 10/1990 | European Pat. Off. . |
| 0 404 022 | 12/1990 | European Pat. Off. . |
| 0 494 425 | 7/1992 | European Pat. Off. . |
| 0 497 509 | 8/1992 | European Pat. Off. . |
| 0 501 785 | 9/1992 | European Pat. Off. . |
| 0 545 621 | 6/1993 | European Pat. Off. . |
| 1420137 | 1/1997 | United Kingdom . |

*Primary Examiner*—Nimeshkumar D. Patel
*Attorney, Agent, or Firm*—Kirschstein, et al.

[57] ABSTRACT

An electron field emission device includes a field emissive cathode which may include a plurality of sharp field emitter tips 2. First and second grids 4 and 7 are located between the cathode and an anode. The grids comprise parallel strips of electrically conductive material, those of the first grid being arranged orthogonal to those of the second. Applications of suitable voltages to the grids enable selected regions of the cathode to be made electron emissive and produce collimated electron beams. The anode may be phosphor coated to produce a visible display or an infra-red image may be produced. Relatively low voltages may be used to switch the regions on and off. As the beams are collimated, the anode may be located a relatively large distance from the cathode, enabling high voltage phosphors to be used.

16 Claims, 5 Drawing Sheets

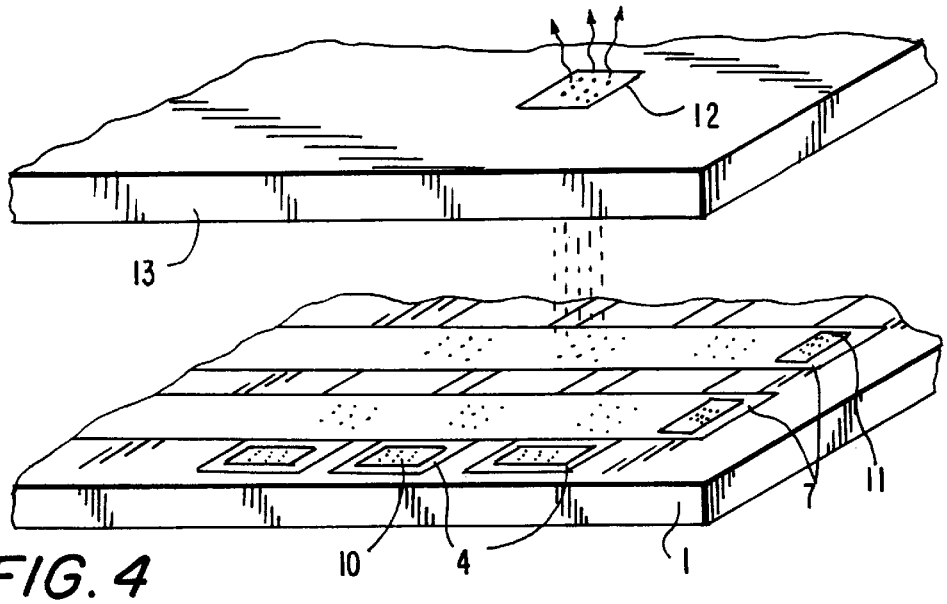
FIG. 4
FIG. 5a
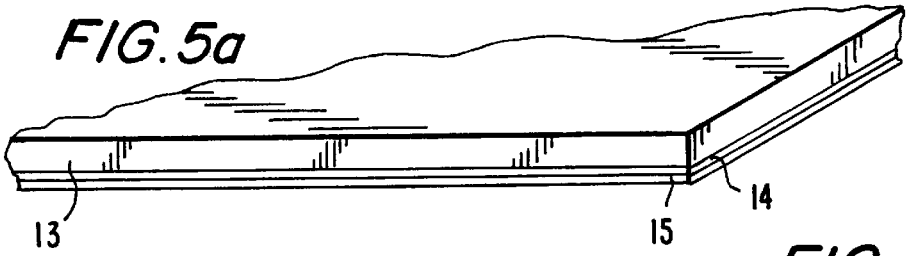
FIG. 5b
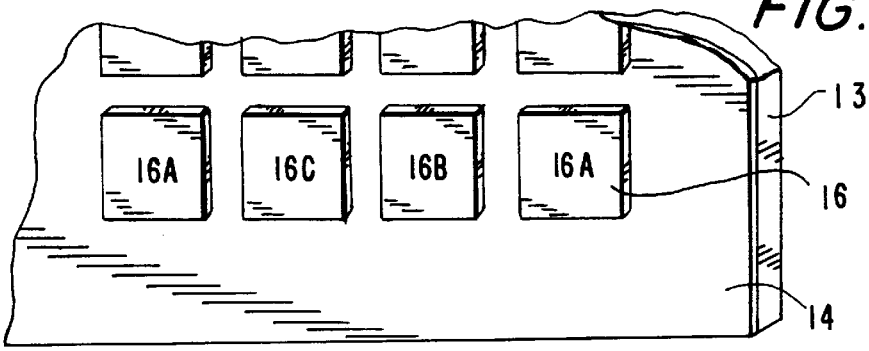
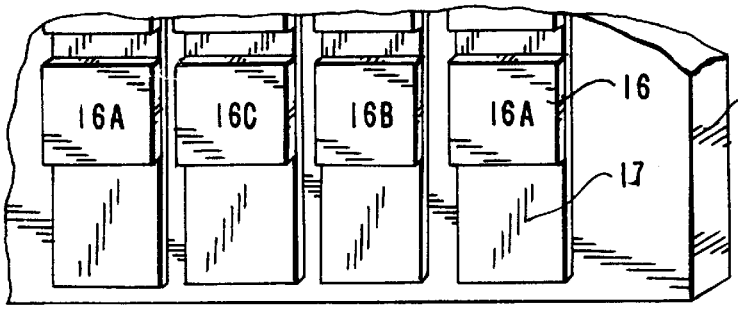
FIG. 5c

FIG. 7a
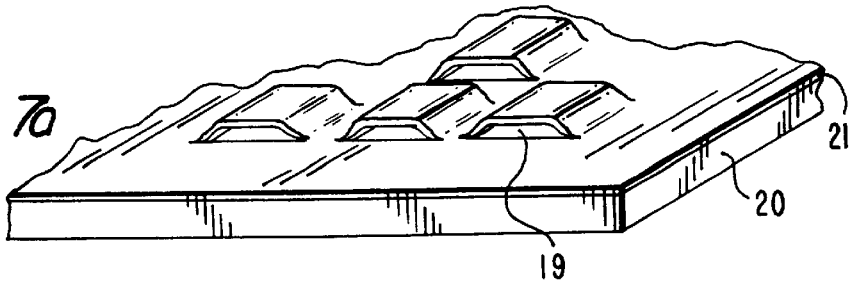
FIG. 7b
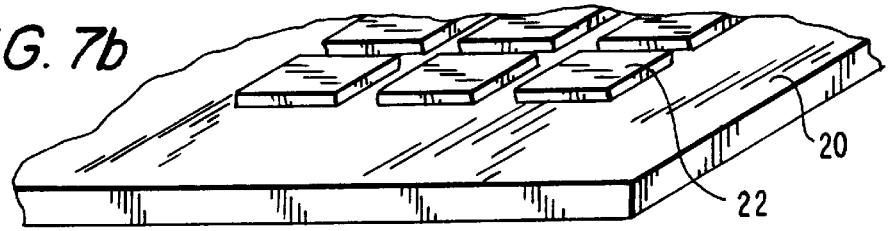
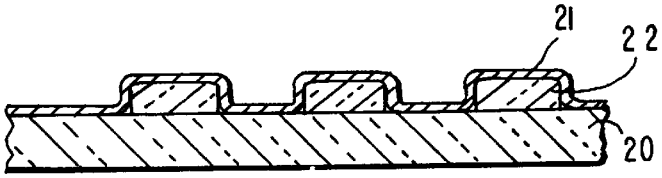
FIG. 7c
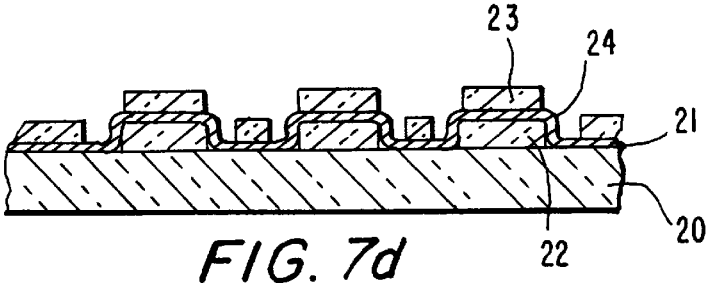
FIG. 7d
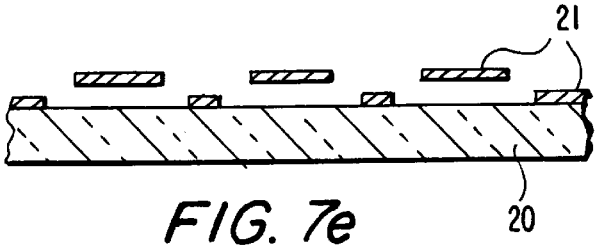
FIG. 7e

ELECTRON FIELD EMISSION DEVICES

This application is a continuation of Ser. No. 08/359,412 filed Dec. 20, 1994 abandoned.

BACKGROUND OF THE INVENTION

This invention relates to electron field emission devices and more particularly, but not exclusively, to display arrangements including such devices.

Much cathode ray tube display technology is now being superseded by both passive and more recently active matrix liquid crystal display technology. This flat panel technology has many advantages over cathode ray tube (CRT) including lighter weight compact shape and lower cost. However, such displays have a number of obvious disadvantages, notably the poor viewing angle and their intrinsically non emissive nature. Although active matrix liquid crystal technology has been developed to overcome the latter deficiency it is at the expense of device complexity and the resulting reduced manufacturing yield leads to high cost, particularly as the technology is scaled up to larger screen sizes. In addition, because such devices involve the shuttering of a back light they are intrinsically inefficient.

A competitive technology based on arrays of field emitter cold cathodes has been developed which provides all the advantages of the flat, liquid crystal display but with the brightness and viewing angle of the cathode ray tube. This novel technology is, however, yet to come into production because the lack of low voltage phosphors and the limited lifetimes of field emitter tips.

SUMMARY OF THE INVENTION

The present invention arose from consideration of an improved field emitter display (FED) but is envisaged that it may also be advantageously employed in non-display applications.

The main drawback with conventional FED devices is that they require close anode screens for proximity focusing of the electron beams emitted from small patches of matrix addressed cathode tips behind each pixel. This close spacing (approximately 100 $\mu$m) requires correspondingly low phosphor voltages (less than 1000 V) relative to the cathode in order to minimise electrical breakdown problems. As a result conventional phosphors technologies used in conventional CRTs cannot be used.

According to the invention, there is provided an electron field emission device comprising: a field emissive cathode and an anode with first and second grids located between them and means for controlling emission from selective areas of the cathode by applying appropriate voltages to the grids, at least one of the grids comprising a plurality of discrete regions which are independently addressable by said means.

Advantageously, the voltages applied by the means for controlling emission are arranged to produce substantially collimated electron emission from a selected area or areas.

The invention concerned is particularly advantageously used in a display device in which the two grid cathode design provides both beam collimation and matrix addressing of the cathode elements behind individual anode regions. Because of the collimated nature of the beam, close spacing of the anode, which may be phosphor coated, is not required and relatively high voltages are possible. As low voltage phosphors are not required, the display offers the possibility of better colour, longer life and ultra-high resolution and brightness greater than that of previously known field emitter displays. It is possible that the characteristics of such a device could be superior to those possible even with CRT technology.

BRIEF DESCRIPTION OF THE DRAWINGS

Some ways in which the invention may be performed are now described by way of example with reference to the accompany drawings in which:

FIG. 4 is a schematic perspective view of a display device in accordance with the invention;

FIGS. 5*a*, 5*b* and 5*c* illustrate different phosphor distributions for a device such as that shown in FIG. 4;

FIGS. 7*a*, 7*b*, 7*c*, 7*d* and 7*e* schematically illustrate an anode structure used in a display device in accordance with the invention and steps involved in its manufacture.

DETAILED DESCRIPTION OF THE PREFERRED EMBODIMENT

Figure 1:
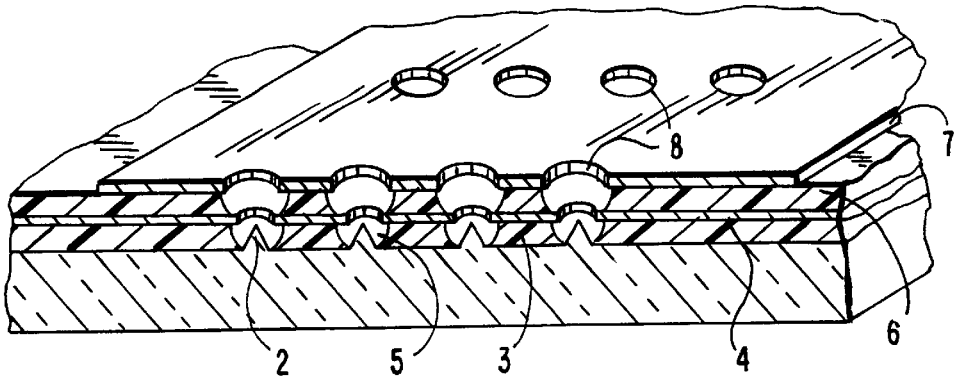
FIG. 1 schematically illustrates a cathode included in a device in accordance with the invention.

A display device in accordance with the invention include a cathode, illustrated in cross-section in FIG. 1, comprising a conductive substrate 1 supporting conductive substantially conical field emission tips 2 typically between 1 and 2 microns in height and with bases about 1 micron across. This structure is overlain by an insulating layer 3, typically between 1 and 2 microns thick, itself overlain by a thin electrically conductive layer, typically 0.3 microns thick, which acts as a first grid 4 and has circular apertures 5 exposing the underlying tips placed concentric with those tips. The grid 4 is further covered by an additional insulator layer 6 and a second metal layer which acts as a second grid 7 and also has aperture 8 centered about the axis of the tips perpendicular to the substrate 1. The aperture in the second grid 7 are typically larger that those in the first and for a first grid aperture of 1.5 microns diameter the second grid typically has a 3 micron diameter. It should be noted that the particular dimensions are only given by way of example and that they could differ substantially depending on the fabrication methods employed and on the particular application requirements.

Figure 2:
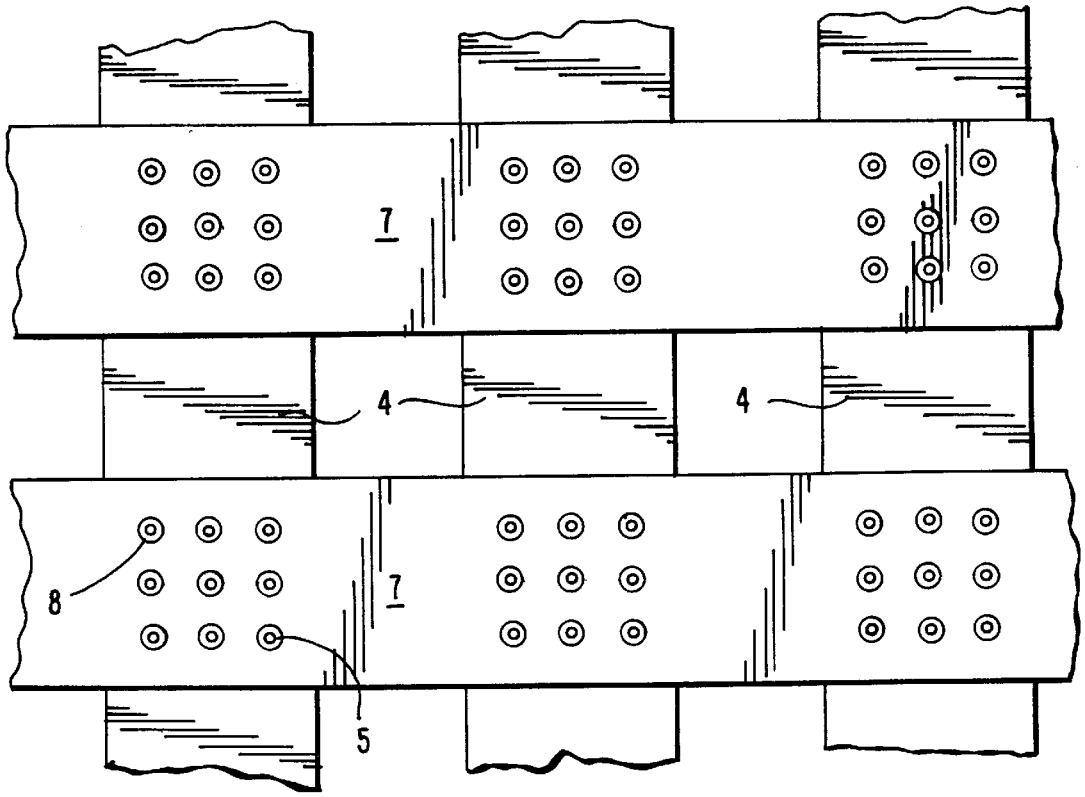
FIG. 2 is a plan view of the cathode shown in FIG. 1.

Each of the grids 4 and 7 comprises parallel strips of conductive material, those of the first being arranged orthogonal to those of the second as shown in FIG. 2 to provide matrix addressing of patches tips at their crossing points. Each patch contains one or more tips aligned with grid apertures in one column of the first grid 4 and in one row of the second grid 7. A method for fabricating an array of tips is described in our co-pending patent application published under serial number GB 2254958A. Although the tips must be electrically conducting and may be composed of the same material as that of the substrate, typically silicon, they could be formed of a different material (molybdenum for example) possibly on an insulating substrate such as a silica glass. Whether the tips are of silicon, molybdenum or another material they may be connected to a common electrical supply (not shown) but may also consist of electrically isolated patches, for example on an insulating substrate, and be separately addressable.

Expressing all voltages relative to that of the tips, the cathode is operated by typically applying +60 V to the first grid 4 and +4 V to the second grid 7 to provide an average emission current greater than 10 nA from each tip. Emission is switched off either by reducing the first grid voltage to about 35 V or by preventing emissions passing the second grid 7 with a second grid bias close to zero. Such a bias reflects the emission back to the first grid 4. Biasing the second grid 7 at about −20 V not only reflects the emission but also suppresses the magnitude of the current, typically to less than a tenth of its "on" value. Thus a modulation of 25 V in the biases on the two grids provide a means of turning on a particular patch within a large array of patches. Sequential addressing of the rows and columns of the grids 4 and 7 results in a time multiplexed emission pattern from the array of cathode patches.

The performance of this cathode may be further enhanced by having the first grid 4 composed of a very resistive material such as polysilicon or amorphous silicon. In this case emission is further suppressed by the charging of the first grid 4 when emission is switched back to it by negative bias on the second grid 7. This enables the complete emission to be switched off by as little as minus one volt applied to the second grid 7 as a consequence of the low energy spread of field emitted electrons. Moreover, such a resistive grid tends to suppress emission from the most emissive tips of the array thus providing a mechanism for reducing emissive current variations across the array of emitter patches. Such a resistive grid also provide a soft failure mechanism whereby the current resulting from an electrical short between the first and the second grid or between the first grid and the tips will not lead to destructing high leakage current.

Figure 3A:
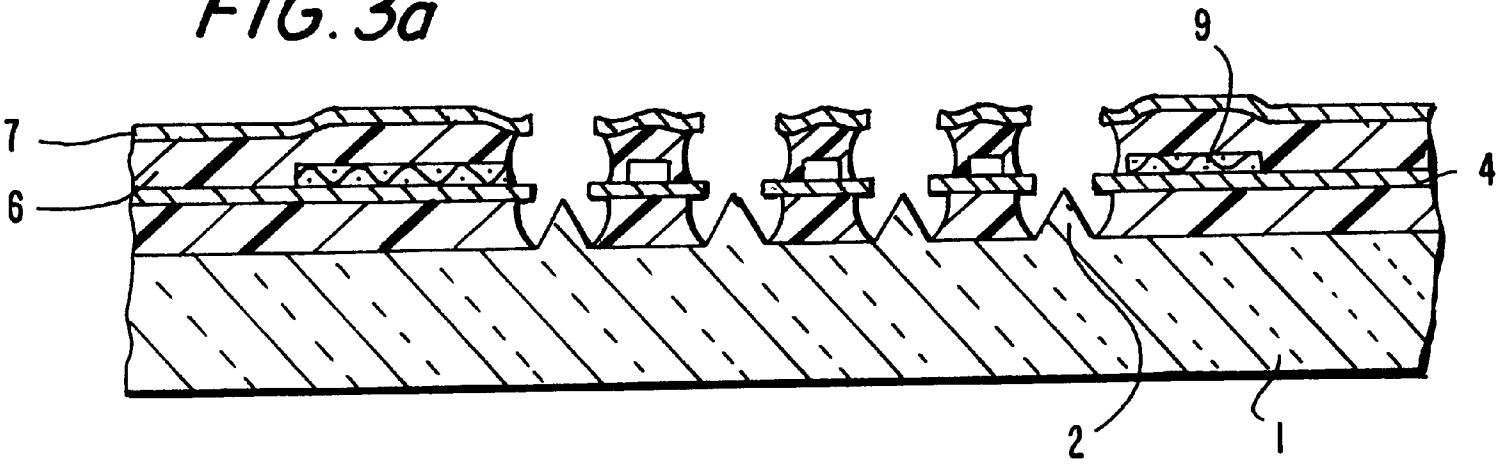
FIGS. 3*a* and 3*b* schematically illustrate sectional views of alternative grid arrangements to those shown in FIG. 1.
Figure 3B:
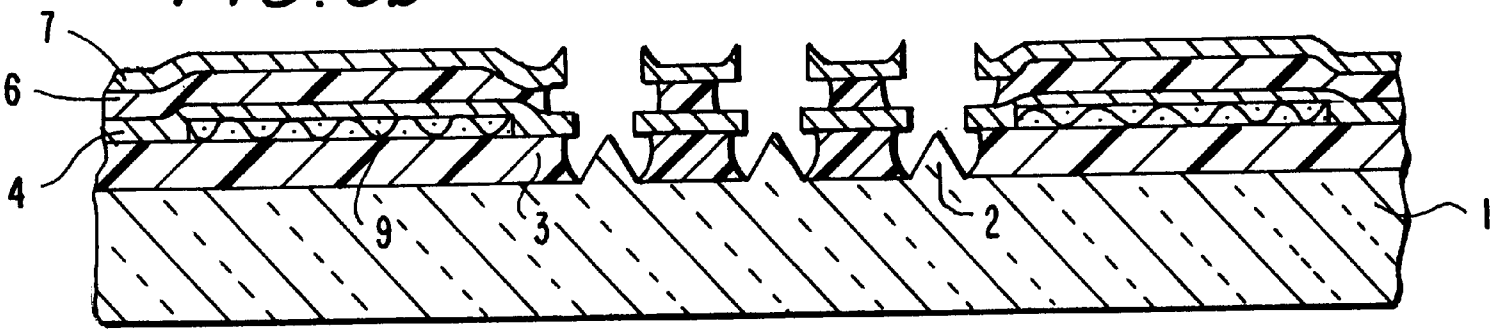

To optimise the effectiveness of this current suppression the first grid 4 preferably include a coarse mesh of conductive material 9 beneath or overlying the high resistivity grid film. Examples of two such structures are shown in FIGS. 3*a* and 3*b*.

When the second grid 7 is at approximately 4 volts positive with respect to the emitter tips 2 any emission current, which depends on the voltage of the first grid, will form an approximately collimated beam emerging perpendicular from the cathode surface. Provided there is a sufficiently high electric field, typically several hundreds of volts per millimeter, in the region above the cathode surface, the resulting angular spread of the beam may have full angular spreads of about one degree or less. The optimal angular spread and the second grid voltage required depends on this external field and on the potential of the first grid. The actual second grid voltage required to switch off the emission is close to the tip voltage plus the work function of the second grid material but is suppressed by both high field above the cathode and by high first grid voltages. Thus emission currents reflected back to the first grid by a sufficiently higher second grid bias may also be transmitted by slight increase of the first grid voltage. Thus it is possible for suitable cathode geometries to switch the emission from cathode patches by modulation of only a few volts on both first and second grids, provided the first grid is sufficiently resistive to suppress the emission current from the tips whenever it is reflected back to the first grid. In the absence of such a mechanism the cathode would tend to be subjected to excessive heating and reduced efficiency.

The collimated nature of the emission from a cathode in accordance with the invention results in a number of devices incorporating such a cathode becoming viable. In particular it is possible to space an anode a few millimeters from the cathode substrate and still maintain a better than 100 micron narrow electron irradiated patch at the anode. If the anode consists of a phosphor coated conducting glass sheet then the matrix addressed cathode is capable of producing light emission from regions of the glass anode 12 having diameters of less than one hundred microns by irradiation with electron emission from patches of the underlying cathodes switched on by application of suitable voltages to a row and column via contact pads 10, as shown in FIG. 4.

The relatively large gap between the cathode and glass anode permits a relatively high voltage, typically between +1000 V and +10,000 to be applied to the anode relative to the cathode and high brightness to be obtained, at about 50% total power efficiency, with only a few tens of nanoamps of current from each cathode patch.

In one embodiment of a display device employing the invention, the anode typically consists of a glass substrate 13 with a coating of Indium Tin Oxide (ITO) 14 and a coating 15 (which may be continuous, as shown, or segmented) of phosphor material overlaying the ITO layer (FIG. 5*a*). Suitable phosphors are conventional CRT phosphors, with or without metal coating, or if lower voltage operations is required fluorescent polymer materials, and particularly those based on polyphenylene vinylene, or any other low voltage phosphor. In a 3-color version, this phosphor layer may consist of an array of three different phosphor "dots" 16A, 16B and 16C as shown in FIG. 5*b*. Each dot is aligned with a corresponding one the cathode patches. Alternatively the ITO may be patterned into parallel tracks 17 with the three different phosphors 16A, 16B and 16C applied sequentially to each in turn as in FIG. 5*c* so that the phosphor to be irradiated is selected by applying the anode bias sequentially to each anode ITO track in turn.

Figure 6:
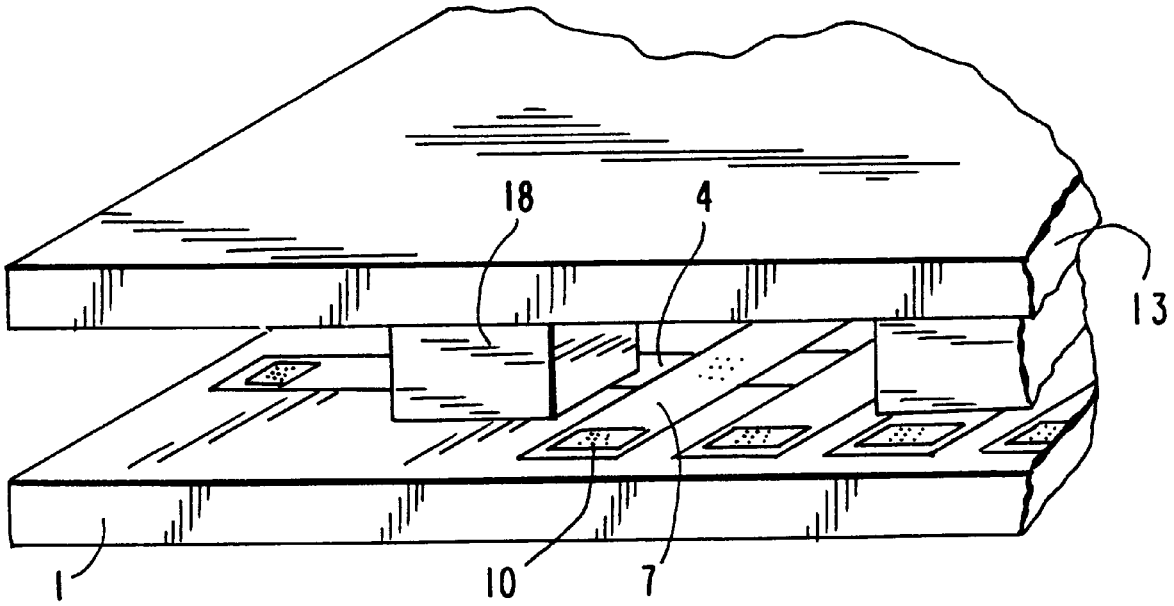
FIG. 6 is a schematic perspective view of another arrangement in accordance with the invention.

The relatively large gap between the anode and cathode and the presence of electron beams within the intervening gap makes it difficult to support the anode by pillars within the area of the cathode. Support may be achieved by using insulating spacers 18 around the periphery of the cathode, positioned between the cathode substrate and anode plate 13 as shown in FIG. 6. The whole sandwich structure is then sealed into an external vacuum tight envelope (not shown) capable of maintaining a high vacuum, typically about $10^{-6}$ mbar. The envelope may be transparent to visible radiation on in other parts of the electromagnetic spectrum.

The eternal envelope, which may have curved walls, results in no structural support being required within the area of the cathode between it and the anode since in this implementation vacuum is maintained within and outside the cathode-anode gap. In a preferred embodiment, the drive electronics for the time multiplexed addressing of individual cathode patches are also accommodated within the eternal envelope so that only a small number of electrical connections need to be made through the wall of the vacuum envelope. The drive circuitry might also advantageously be fabricated on the substrate of the cathode structure where this is of silicon or some other appropriate material.

Although it is envisaged that the cathode is fabricated on a single substrate it might also be built up from a number of separate cathode tiles. Similarly, although it is intended that in most arrangements the anode consists of a single glass sheet, in another embodiment of the invention, a number of separate cathode and anode modules could be included within the one envelope.

With a phosphor coated anode the device provide a visibly display. If the anode comprises an infra-red transparent material such as quartz or sapphire and the conducting layer is a thin metal sheet then the device can provide an infra-red display. In this case, higher electrical currents are requires such that the combination of high current and high anode voltage gives significant anode heating. In further modification, the performance of such a device may be improved by having an anode structure which includes a thin metal sheet 21 in the form of multiple bridge structures 19, as shown in FIG. 7*a,* in which there are unsupported regions of metal with a vacuum (or gas) gap between the metal and the anode substrate 20. Similar constructions are disclosed in our previous application published under serial number GB 2209432A. Such structures may be formed by firstly coating the IR transparent material 20 with a sacrificial material, such as a CVD deposited silica glass on an organic resist, patterning it to leave only pillars 22 of the material (as shown in FIG. 7*b*); coating the whole surface with a thin metal layer 21 (FIG. 7*c*); patterning this layer with a resist mask 23 with aperture 24 over the edges of the metal domes (FIG. 7*d*) and etching away the exposed metal. The resist is then removed and the sacrificial layer dissolved via the apertures formed in the metal layer. Thus regions of thin metal are formed supported only by their edges (as shown in FIG. 7*e*). The thinness of the material gives low heat capacity and the low thermally conductive path to the substrate combines with the high thermal conductivity of the substrate 20, such that relatively little electron beam power is required to produce a hot IR emissive metal film and yet the film rapidly returns to ambient temperature once the electron beam is turned off. As with the high emission device, these the bridge structures might advantageously be aligned directly above corresponding cathode patches on the cathode substrate and by sequentially addressing the rows and columns of the cathode array a dynamic (in this case infra-red) emission scene may be displayed on the anode surface.

I claim:

1. An electron field emission device, comprising: a field emissive cathode including an array of sharp tips, and an anode with first and second grids located between them, each of the first and second grids including a plurality of substantially parallel conductive strips, the strips of the first grid being arranged substantially orthogonal to the strips of the second grid; and means for controlling emission from selected areas of the cathode by applying appropriate voltages to the grids, the selected areas of the cathode that are aligned with intersections of a row of one of the grids and a column of the other of the grids being arranged to emit an electron beam by the application of the appropriate voltages to said row and said column.

2. A device as claimed in claim 1 when the voltage applied by the means for controlling emission are arranged to produce substantially collimated electron emission from a selected area or areas.

3. A device as claimed in claim 1 wherein at least one of the emitter tips and cathode substrate are of silicon.

4. An arrangement as claimed in claim 1 wherein the anode is spaced from the cathode by at least one millimeter.

5. A device as claimed in claim 1 wherein electron beams emitted from the cathode are arranged to impinge on the anode to produce a display.

6. A device as claimed in claim 5 wherein the display is an image in the visible part of the spectrum.

7. A device as claimed in claim 5 wherein the anode comprises phosphor material on which the electron beams are arranged to impinge.

8. A device as claimed in claim 7 wherein different phosphor material having different light emission characteristics are distributed over the anode surface.

9. A device as claimed in claim 8 wherein the anode comprises strips of electrically conductive material on which phosphor material is carried and means are included for deflecting electrons beams at the anode by biasing the anode conductive strips to control the region of phosphor material which is irradiated by the electron beam.

10. A device as claimed in claim 5 wherein the display comprises an infra-red image.

11. A device as claimed in claim 10 wherein the anode comprises an electrically insulating, infra-red transparent substrate having a metal coating.

12. A device as claimed in claim 11 wherein the metal coating includes portions raised from the substrate such that there is a vacuum or gas gap between the metal portion and the anode substrate.

13. A device as claimed in claim 1 wherein the grid nearest the cathode comprises a substantially electrically resistive material.

14. A device as claimed in claim 1 wherein support pillar means is located around the periphery of the cathode to support the anode relative to the cathode.

15. A device as claimed in claim 1 and including a gas tight enclosure within which the anode, cathode and grids are located.

16. A device as claimed in claim 1 wherein the tips are electrically connected on a common conducting substrate.

* * * * *